United States Patent [19]

Alivizatos

[11] Patent Number: 4,606,087

[45] Date of Patent: Aug. 19, 1986

[54] CONVERTIBLE BODY SUPPORTING PADS

[76] Inventor: Margaret A. Alivizatos, 11056 Shady Trail, Suite 113, Dallas, Tex. 75229

[21] Appl. No.: 683,067

[22] Filed: Dec. 18, 1984

Related U.S. Application Data

[63] Continuation-in-part of Ser. No. 650,800, Sep. 14, 1984.

[51] Int. Cl.[4] ..... A47D 13/00; A47D 15/00

[52] U.S. Cl. ..... 5/424; 5/420; 5/449; 190/2; 383/4

[58] Field of Search ..... 5/455, 417, 420, 431, 5/450, 424, 442, 449; 297/DIG. 3; 383/4, 902; 190/1, 2

[56] References Cited

U.S. PATENT DOCUMENTS

| | | | |
|---|---|---|---|
| 2,479,203 | 8/1949 | Brown | 383/4 |
| 3,235,306 | 2/1966 | Chernivsky | 297/296 |
| 3,818,962 | 6/1974 | Muller-Scherak | 5/455 |
| 3,879,775 | 4/1975 | Iwata | 5/442 |
| 3,968,911 | 7/1976 | Haas | 297/192 |
| 4,546,507 | 10/1985 | Weinstein | 5/419 |

FOREIGN PATENT DOCUMENTS

| | | | |
|---|---|---|---|
| 3320847 | 7/1984 | Fed. Rep. of Germany | 297/DIG. 3 |

*Primary Examiner*—Alexander Grosz

*Attorney, Agent, or Firm*—Hubbard, Thurman, Turner & Tucker

[57] ABSTRACT

Support pads or mattresses are formed from flexible fabric closed covers of generally rectangular configuration forming a chamber or space which is filled to approximately 50% of its normal maximum volume with relatively small expanded polystyrene beads. In one embodiment the pad is formed with intersecting disconnectable straps for restraining an infant in a generally reclined position on the pad. The pad may be converted for use as a carrying bag or container by forming a cavity or receptacle in one end of the cover by displacing the flowable polystyrene beads and utilizing one of the straps as a carrying strap for the bag, thereby providing a protective insulated carrier for various articles. One embodiment of the pad includes a segmented fabric cover forming a plurality of pockets for receiving individual pads or cushions whereby the pad may be utilized as a lounging mattress, swimming pool float, chair, or bench seat. Each of the individual cushions may be removed from the segmented cover for distribution and use in supporting various parts of the human body.

9 Claims, 11 Drawing Figures

CONVERTIBLE BODY SUPPORTING PADS

CROSS-REFERENCE TO RELATED APPLICATION

This application is a continuation-in-part of U.S. patent application Ser. No. 650,800 filed Sept. 14, 1984.

BACKGROUND OF THE INVENTION

1. Field of the Invention

The present invention pertains to support pads or cushions comprising flexible fabric covers partially filled with expanded polystyrene beads. One embodiment is convertible to a carrying bag for infant articles and the like and another embodiment includes a plurality of bags enclosed in a segmented cover for use as a mattress, pool float, hassock, chair or patient support structure.

2. Background

The above-referenced patent application pertains to improvements in support pads characterized generally by a flexible fabric cover or sack which is closed to contain a specified quantity of generally spherical expanded polystyrene beads having a closed cell construction and wherein the pads so formed provide improved force distributing support for infants and patients suffering from various infirmities. The present invention pertains to certain improvements in articles for supporting infants as well as persons of all ages for various purposes including recreation and any situation where a comfortable at-rest position is desired.

For example, there is a particular need for a portable pad or cushion for supporting an infant in various positions wherein the infant should be restrained from falling off of the pad and wherein it is desirable to utilize the pad for other purposes such as carrying various articles needed in the care and feeding of the infant when traveling or visiting away from the home.

There is also a recognized need for articles which enjoy the benefits of the invention disclosed in the above-referenced application and which also may be used for other purposes in supporting one or more persons in an at-rest position, during convalescence from some infirmity or for recreational or leisure uses. It is to this end that the present invention has been developed as will be appreciated by those skilled in the art upon reading the following summary and description of the invention.

SUMMARY OF THE INVENTION

The present invention provides an improved support pad or cushion which provides improved support for an infant or small child and which is convertible into use as a bag or container for carrying various articles. In accordance with an important aspect of the invention, there is provided a convertible infant support pad or cushion comprising a fabric sack or cover which is of generally rectangular shape and is provided with a fill material in the form of expanded, generally spherical polystyrene or similar type plastic beads which are free to flow within the interior of the cover from one area to the other to provide improved support for an infant or small child. The support pad includes restraining means in the form of flexible straps which restrain the infant or child from falling off of the pad when in use.

In accordance with another important aspect of the present invention, there is provided a support pad or cushion for use in carrying and supporting an infant when traveling or visiting away from the home which includes means for restraining the infant from falling off of the pad and whereby the pad may be converted to a container or carrying bag utilizing the restraining means as a carrying handle. The provision of a flexible fabric cover partially filled with flowable plastic beads provides for forming a recess in the pad which is suitable for carrying various types of articles and which has superior insulation properties.

In accordance with another aspect of the present invention, there is provided cushion means including a plurality of generally closed flexible fabric covers which are each partially filled with flowable expanded polystyrene or similar type plastic beads and are each enclosed in a segmented fabric outer cover or bag whereby the separate cushions may be inserted in or removed from the outer cover as needed for a particular arrangement. The segmented outer cover and plural cushion or pad combination may be advantageously used as a buoyant cushion or camping mattress as well as a lounging mattress or as a chair or hassock. Moreover, the plural cushion support pad or mattress may be used to support patients which are suffering from certain infirmities or simply need to be supported in different positions for comfort or for therapeutic purposes.

Those skilled in the art will recognize the above-described features and advantages of the present invention as well as additional superior aspects thereof upon reading the detailed description which follows in conjunction with the drawing.

DESCRIPTION OF THE PREFERRED EMBODIMENTS

Figure 1:
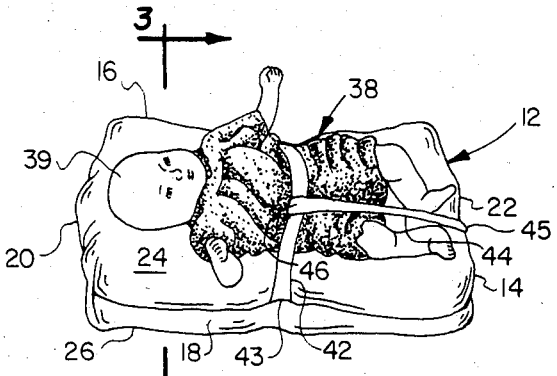
FIG. 1 is a perspective view of a convertible infant support pad in accordance with the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Figure 2:
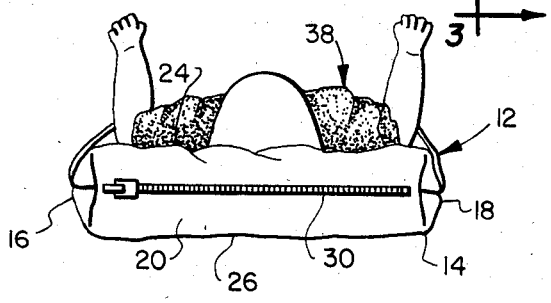
FIG. 2 is an end view of the support pad shown in FIG. 1.
Figure 3:
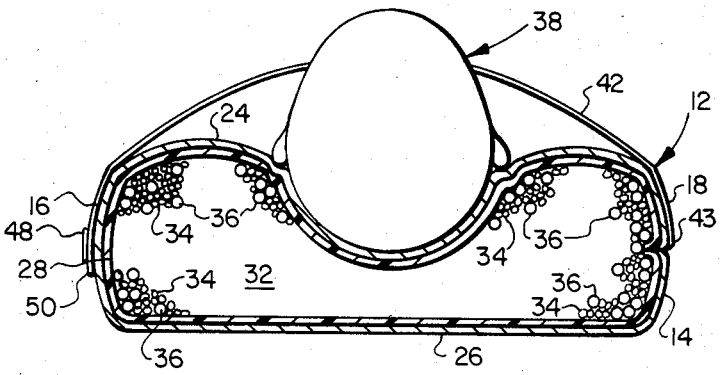
FIG. 3 is a section view taken generally along the line 3—3 of FIG. 1.

Referring to FIGS. 1 through 3, in particular, there is illustrated a convertible infant support pad in accordance with the present invention and generally designated by the numeral 12. The convertible support pad 12 is of generally rectangular form and includes a flexible fabric cover 14 having opposed sidewalls 16 and 18, end walls 20 and 22 and upper and lower support surfaces formed by panels 24 and 26. The support pad 12 may include an inner liner 28, FIG. 3 which is of substantially the same general shape or configuration as the cover 14 and over which the cover 14 may be disposed through a slot 29, FIG. 5, in the end wall 20 which is shown closed by a conventional slide fastener 30, FIG. 2.

The inner liner 28 forms a generally rectangular closed sack which may be made of a liquid impervious fabric or monosheet to define an interior space 32, FIG. 3, which may be at least partially filled with a substantial quantity of small plastic beads 34 and 36. The beads 34 and 36 are preferably formed of expanded polystyrene foamed plastic and are a mixture of beads having a diameter ranging from approximately 0.062 inches to 0.188 inches in diameter, being generally spherical in shape and being formed with a substantially fluid impermeable outer surface.

The interior space 32 is filled to approximately 50% of its maximum volume with a quantity of beads 34 and 36 and the generally rectangular shape of the liner 28 and the cover 14 allows a sufficient flow of the beads to present a suitable contoured depression in the top panel 24 of the cover to provide improved support and containment of an infant child, generally designated by the numeral 38. The nominal dimensions of the support pad 12 are preferably approximately 20.0 to 28.0 inches in length, having a width of 12.0 to 18.0 inches and a height or depth of about 2.0 to 4.0 inches. Although the interior chamber or space 32 may be formed only within the outer cover 14, in a preferred form of the invention, it is considered preferable to provide the liner or inner sack 28 for containing the fill beads 34 and 36 whereby the outer cover 14 can be removed from the inner liner for cleaning or replacement, if necessary, without replacing the entire pad itself. Moreover, the outer cover may be made of a suitable fabric having a desirable feel or aesthetic properties and which is washable or replaceable while the inner liner is made of a substantially liquid impervious material.

Figure 4:
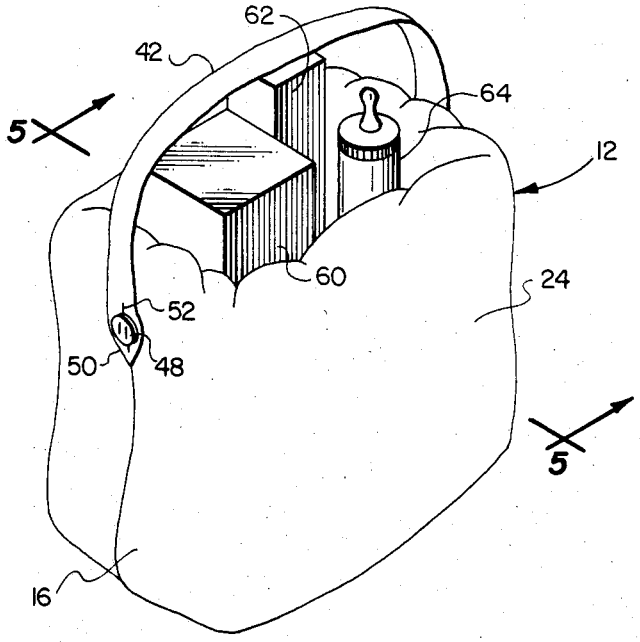
FIG. 4 is a perspective view of the support pad illustrated in FIGS. 1 through 3 converted for use as a bag or container for carrying various articles.
Figure 5:
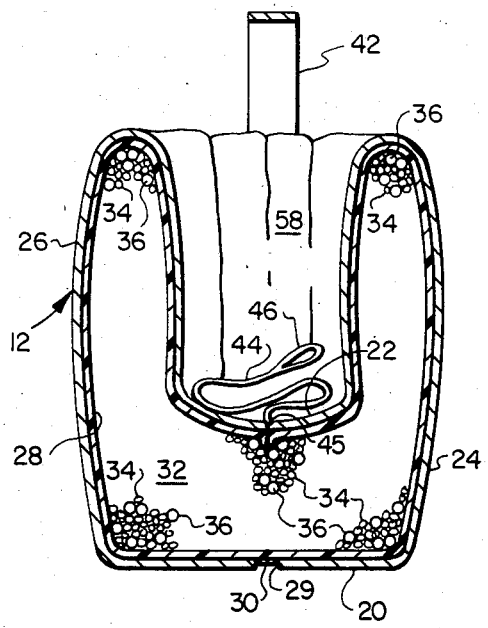
FIG. 5 is a section view taken along the line 5—5 of FIG. 4 with the articles removed from the bag receptacle.

Referring further to FIGS. 1 through 3 and also FIGS. 4 and 5, the convertible support pad 12 is also provided with interconnected flexible restraining straps 42 and 44. The strap 44 is suitably secured at an end 45 to the end wall or panel 22 generally midway between the opposite sidewalls or panels 16 and 18. The strap 44 is formed at its opposite end into a closed loop 46, FIGS. 1 and 5. The strap 42 is secured at one end 43 to the sidewall or panel 18 and is detachably secured to the opposite sidewall or panel 16 by fastener means such as a button 48, FIGS. 3 and 4. Accordingly, the strap 42 is formed with a free end 50 which may be provided with a suitable opening or buttonhole 52, FIG. 4, for detachably securing the free end 50 to the sidewall or panel 16 whereby the strap 42 may be detached from the sidewall 16 and withdrawn from connection with the strap 44 by removal from the closed loop 46 and then reattached to the button 48 as illustrated in FIG. 4, if desired, for a purpose to be explained herein. Alternatively, in accordance with the present invention, the strap 44 may be suitably connectable at the end formed into the closed loop 46 by suitable fastener means, not shown, and the strap 42 permanently attached at its opposite ends to the sidewalls or panels 16 and 18.

As illustrated in FIGS. 1 and 3, the strap 42 may be passed over the body of the infant 38 in the region of the infant's torso and when connected to the strap 44 provide restraining means for preventing the infant from falling off of the pad in either a generally horizontal position of the pad or, if desired, the pad 12 may be propped at an angle to elevate the infant's head 39 above the horizontal for added comfort.

Referring further to FIGS. 4 and 5, the convertible support pad 12 is uniquely configured to serve as a carrying bag or container, as illustrated, by depressing the end wall or panel 22 in toward the interior space 32 to form a cavity or receptacle 58 in which, as shown in FIG. 4, certain articles 60, 62 and 64 may be disposed and carried about utilizing the strap 42 as a carrying strap. For example, the articles 60, 62 and 64 may comprise such things as diapers, tissues or food containers for use in caring for the infant 38 when traveling away from the home.

Thanks to the provision of the generally rectangular construction of the cover 14 and the liner 28 and by maintaining a quantity of flowable fill material such as the beads 34 and 36 in the range of about 50% of the maximum volume of the interior space or chamber 32 the pad 12 may be adapted to form the relatively deep receptacle 58 for use as a carrying container or bag. In this regard, it is preferable to disconnect the straps 42 and 44 from each other and by forming the cavity utilizing the end wall or panel 22, the strap 44 is automatically placed in the bottom of the cavity 58 out of the way.

Accordingly, the convertible support pad 12 is particularly useful for caring for an infant outside the home as well as therein, for use as a mattress with suitable restraining means comprising the straps 42 and 44 and whereby the infant may be placed at rest on the pad 12 without concern that the infant may inadvertently roll off of the pad and injure itself. The provision of the restraining straps 42 and 44 together with the body shape conforming properties of the pad 12 improves the support and retention of the infant in a predetermined position on the pad. Moreover, the pad 12 may be propped at a desired angle to allow the infant to view goings on about it while being restrained on the pad by the straps 42 and 44 and the depression in the top panel 24. Of course, while moving about when carrying the infant over one's shoulder, or otherwise, the convertible pad 12 may be utilized as a carrying bag or container by, preferably, disconnecting the straps 42 and 44 from each other, forming the cavity 58 in one end of the pad, as illustrated in FIGS. 4 and 5, and utilizing the strap 42 as a carrying strap. Although the straps 42 and 44 may be left connected to each other, by disconnecting the strap 42 from the strap 44 the strap 44 may be conveniently folded and placed at the bottom of the cavity 58, as illustrated in FIG. 5, to provide more unobstructed space for placing articles within the cavity.

Figure 6:
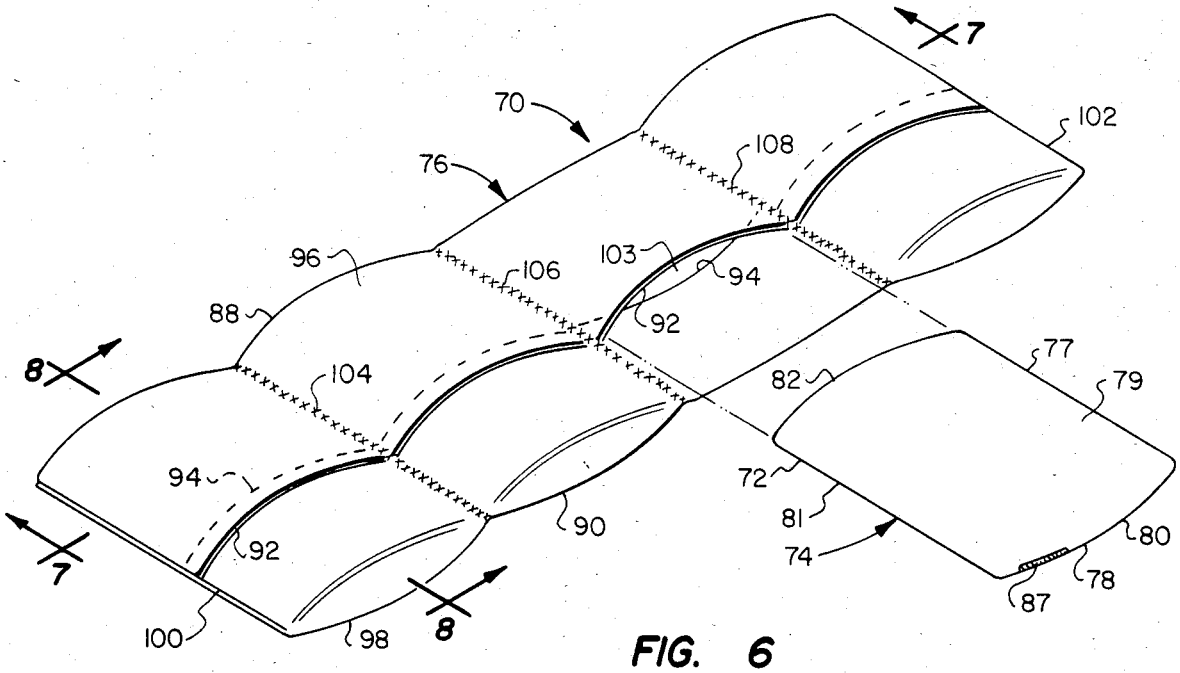
FIG. 6 is a perspective view of a support pad or mattress in accordance with an alternate embodiment of the present invention.
Figure 7:
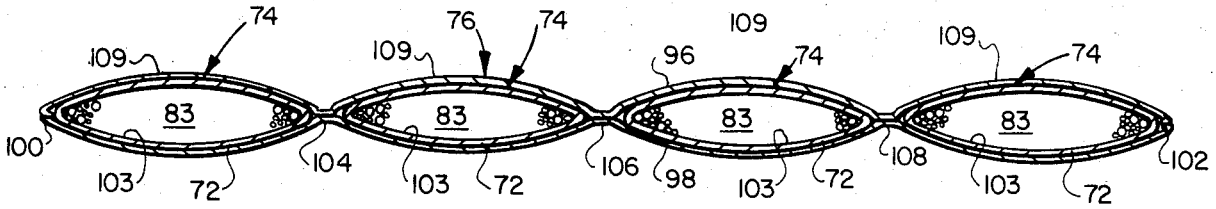
FIG. 7 is a section view taken generally along the line 7—7 of FIG. 6.
Figure 8:
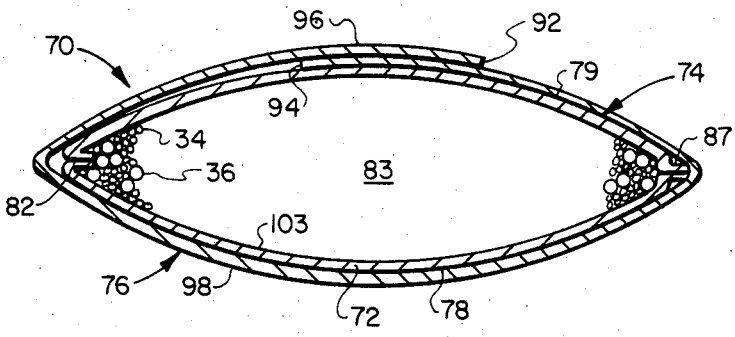
FIG. 8 is a section view taken along the line 8—8 of FIG. 6.

Referring now to FIGS. 6 through 8 an alternate embodiment of the present invention comprising a multi-use support pad is illustrated and generally designated by the numeral 70. The support pad 70 is characterized by a plurality of flexible fabric closed sacks or covers 72 forming respective separate pillows or cushions 74 which are removably disposed in a segmented cover, generally designated by the numeral 76. Each of the separate cushions 74 is adapted to have a generally rectangular fabric cover 72 preferably formed from a single piece of fabric folded generally along a line 77 to form a bottom panel 78 and a top panel 79. The cover 72 is preferably sewn to itself along seams 80, 81 and 82 to form the enclosed space 83, FIGS. 7 and 8, which is partially filled with the expanded foam beads 34 and 36. Each cushion 74 is provided with a sufficient quantity of beads 34 and 36 to occupy approximately 50% of the maximum volume of the enclosed space 83. Each cushion 74 is filled with a sufficient quantity of beads 34 and 36 through an opening which is closed by a short external seam 87 and initially providing an opening through which the cover 72 may be inverted after sewing the seams 80, 81 and 82 so that the selvage of the seams is within the space 83.

The cover 76 is preferably formed from a single piece of fabric which is folded along longitudinal fold lines 88 and 90, FIG. 6, to form overlapping longitudinal edges 92 and 94 and defining top and bottom panels 96 and 98. The cover 76 is closed at its opposite ends by inverted seams 100 and 102, and respective cushion receiving pockets 103 are formed for each of the cushions 74 by sewing the top and bottom panels 96 and 98 to each other along lateral, equally spaced stitch lines 104, 106 and 108. The formation of the stitch lines 104, 106 and 108 provide equal sized cushion segments 109 for the pad 70 when each of the cushions 74 are inserted in their respective pockets 103. The respective cushion 74 may be easily inserted in and removed from the pockets 103 by separating the marginal edges 92 and 94 between adjacent seams or closures formed by the respective stitch lines 100, 104, 106, 108 and 102 whereby the cushions may be used to form the segmented pad 70 or may be used separately for various purposes. As illustrated in FIG. 6, for example, a cushion 74 is shown removed from its pocket 103 and the flexibility of the fabric cover 76 as well as the deformability of each of the cushions 74 permits relatively easy insertion and removal with respect to the individual pockets 103.

The segmented support pad 70 is particular versatile and may be used as a lounging cushion, as a swimming pool flotation device or during various hydrotherapy, for example. A preferred material for use in making the cushions 74 and the cover 76 is a woven synthetic fabric typically known as industrial poplin, although several other fabric materials may be used. Industrial poplin as well as certain other fabrics are not watertight, but the closed cell plastic beads 34 and 36 preclude the permanent absorption of water by each of the cushions 74 and they may be drained after removal from a body of water by merely hanging them up to allow gravity draining and evaporation. Moreover, the cushions 74 and the cover 76 are conveniently washable. By forming each of the cushions 74 to have a length of approximately 24.0 to 28.0 inches, a width of approximately 16.0 to 18.0 inches and an average thickness at the center of about 3.0 to 4.0 inches and with a 50% fill of beads 34 and 36 sufficient buoyancy is maintained to support a person of average weight of from about 150 to 200 pounds.

Figure 9:
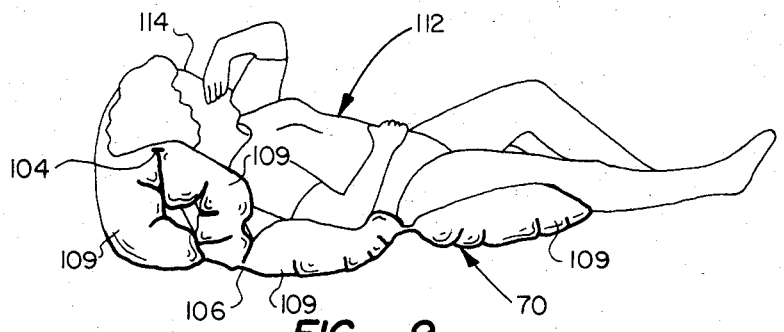
FIG. 9 is a perspective view of the support pad of FIGS. 6 through 8 in use as a lounging cushion.
Figure 10:
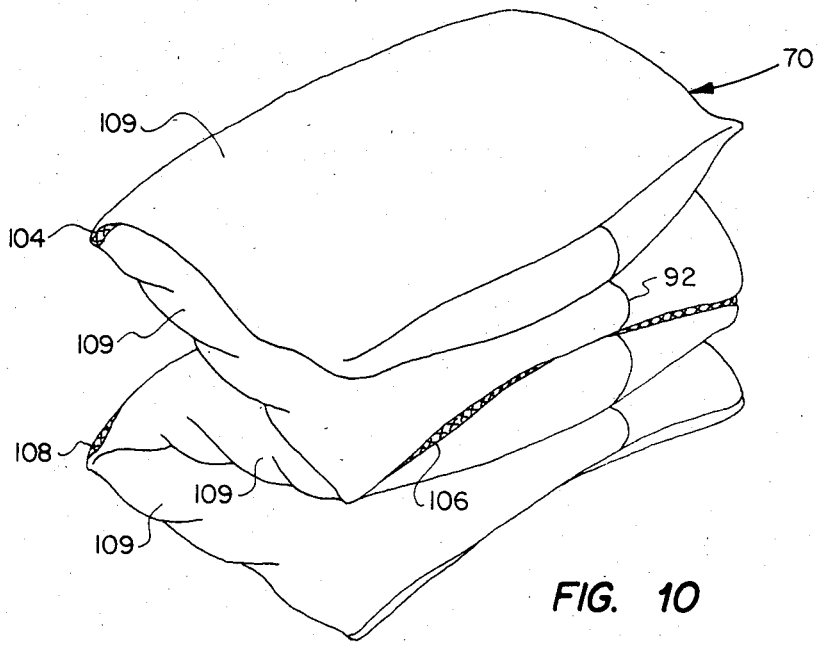
FIG. 10 is a perspective view of the support pad illustated in FIGS. 6 through 9 folded to form a hassock.
Figure 11:
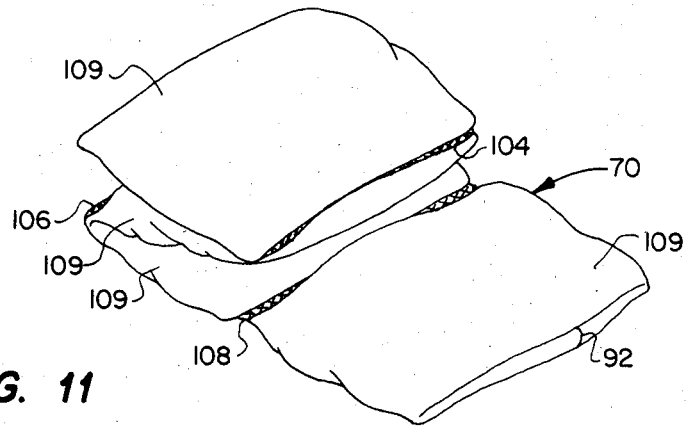
FIG. 11 is a perspective view of the segmented support pad folded to form a chair.

Referring now to FIG. 9, one arrangement of the support pad 70 is illustrated for supporting a person 112 in a substantially reclining or prone position with the head 114 slightly elevated by folding the support pad at the hinges formed by the stitch line 106 and at the stitch line 104 so that two of the pad segments 109 act as pillows while the remaining two pad segments 109 support the torso and thighs. As illustrated in FIG. 10, the pad segments 109 may be stacked one on top of each other to form the segmented pad 70 into a hassock or the like. As illustrated in FIG. 11, the pad 70 may be formed into a chair with two of the pad segments 109 stacked on top of a third pad segment to form the chair back and wherein the fourth segment is left extending from the third segment to form the chair cushion. The positions of the support pad 70 illustrated in FIGS. 9, 10 and 11 are exemplary of the various ways that the unique features of the pad may be utilized.

By utilizing the cushions 74, which are approximately 50% filled with the flowable plastic beads 34 and 36, in virtually any position of the pad 70 it molds comfortably to body contours thereby eliminating uncomfortable pressure points over bony prominences of a person's body or over locations of an injury or sore which might cause pain when required to form a support point for the body. Of course, one or more of the cushions 74 may be removed from the cover 76 and used separately as limb or lumbar supports. For example, by turning one or more of the cushions 74 to lie on a seam 81 or fold line 77, the cushion may be suitably deformed to support a foot at the correct angle relative to the leg to prevent foot drop and heel pressure. Any one of the four cushions 74 may be used separately in the manner mentioned above, for example.

Althought preferred embodiments of the present invention have been described in detail herein, those skilled in the art will recognize that various substitutions and modifications may be made to the specific embodiments disclosed without departing from the scope and spirit of the invention as recited in the apended claims.

What I claim is:

1. A convertible support pad for infants comprising: a generally rectangular flexible fabric cover forming a closure defining an interior space which is partially filled with a flowable material for conforming to a body or limb supported on a support surface formed along one panel of said cover and distributing support forces uniformly thereover;

first flexible restraining strap means extending from one longitudinal side of said pad across to the other longitudinal side of said pad, said first strap means being releasably connectable to one of said sides; and second flexible restraining strap means extending from one tranverse end of said cover to a point substantially midway between opposite ends of said first strap means and secured to said first strap means, said strap means being cooperable to restrain an infant on said support surface, said cover being invertable at one end of said pad to form a cavity whereby said pad is convertible to a carrying bag for carrying articles in said cavity and carried by at least one of said strap means.

2. The convertible pad set forth in claim 1 wherein: said space is filled to about 50% of its maximum volume by said fill material.

3. The convertible pad set forth in claim 2 wherein: said fill material comprises a quantity of generally spherical beads of expanded polystyrene having a diameter of about 0.062 inches to 0.188 inches.

4. The convertible pad set forth in claim 2 wherein:

said pad includes a fluid impervious flexible liner interposed between said cover and enclosing said space.

5. The convertible pad set forth in claim 4 wherein:

said cover includes a closable slot formed thereon and fastener means for closing said slot whereby said liner can be inserted in and removed from said cover.

6. The convertible pad set forth in claim 1 wherein:

said second strap means is releasably connected to said first strap means at one end of said second strap means so that said second strap means can be deposited in said cavity when said pad is converted to said bag.

7. The convertible pad set forth in claim 1 wherein:

said first strap means is secured to said cover about midway between opposite transverse ends of said cover.

8. A convertible support pad for infants comprising:

a generally rectangular flexible fabric cover forming a closure defining an interior space which is filled to about 50% of its maximum volume with a quantity of generally spherical beads of expanded polystyrene having a diameter of about 0.062 inches to 0.188 inches with a flowable material for conforming said pad to a body or limb supported on a support surface formed along one panel of said cover and distributing support forces uniformly thereover;

first flexible restraining strap means extending from one longitudinal side of said pad across to the other longitudinal side of said pad, said first strap means being releasably connectable to one of said sides; and second flexible restraining strap means extending from one transverse end of said cover to a point substantially midway between opposite ends of said first strap means and secured to said first strap means, said strap means being cooperable to restrain an infant on said support surface, said cover being invertable at one end of said pad to form a cavity whereby said pad is convertible to a carrying bag for carrying articles in said cavity and carried by at least one of said strap means.

9. The convertible pad set forth in claim 8 wherein:

said second strap means is releasably connected to said first strap means at one end of said second strap means so that said second strap means can be deposited in said cavity when said pad is converted to said bag.

* * * * *